US006872499B2

(12) United States Patent
Sato et al.

(10) Patent No.: US 6,872,499 B2
(45) Date of Patent: Mar. 29, 2005

(54) DEVELOPING AGENT

(75) Inventors: Shuitsu Sato, Tokyo (JP); Takashi Urabe, Shizuoka-ken (JP); Yasuhito Noda, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 127 days.

(21) Appl. No.: 10/391,602

(22) Filed: Mar. 20, 2003

(65) Prior Publication Data

US 2004/0185355 A1 Sep. 23, 2004

(51) Int. Cl.[7] ..... G03G 9/10
(52) U.S. Cl. ..... 430/107.1; 430/109.4
(58) Field of Search ..... 430/107.1, 109.4

(56) References Cited

U.S. PATENT DOCUMENTS 5,057,392 A * 10/1991 McCabe et al. ..... 430/109.2
5,677,100 A 10/1997 Asano et al.
6,383,705 B2 * 5/2002 Aoki et al. ..... 430/109.4

FOREIGN PATENT DOCUMENTS

| | | |
|---|---|---|
| JP | 7-175260 | 7/1995 |
| JP | 8-171231 | 7/1996 |
| JP | 9-160293 | 6/1997 |
| JP | 2000-29243 | 1/2000 |
| JP | 2001-272820 | 10/2001 |

OTHER PUBLICATIONS

U.S. Appl. No. 10/230,136, Sato et al., filed Aug. 29, 2002.
U.S. Appl. No. 10/342,368, Sato, filed Jan. 15, 2003.
U.S. Appl. No. 10/358,235, Sato et al., filed Feb. 5, 2003.
U.S. Appl. No. 10/293,323, Urabe et al., filed Nov. 14, 2002.

* cited by examiner

*Primary Examiner*—Mark A. Chapman
(74) *Attorney, Agent, or Firm*—Foley & Lardner LLP

(57) ABSTRACT

A developing agent comprising color toners and a cyan toner, the color toners including a yellow toner, a magenta toner, and a black toner, wherein the black toner comprises a binder resin containing a crystalline polyester resin, and the yellow toner, the magenta toner and the cyan toner each comprise a binder resin containing no crystalline polyester resin.

2 Claims, 1 Drawing Sheet

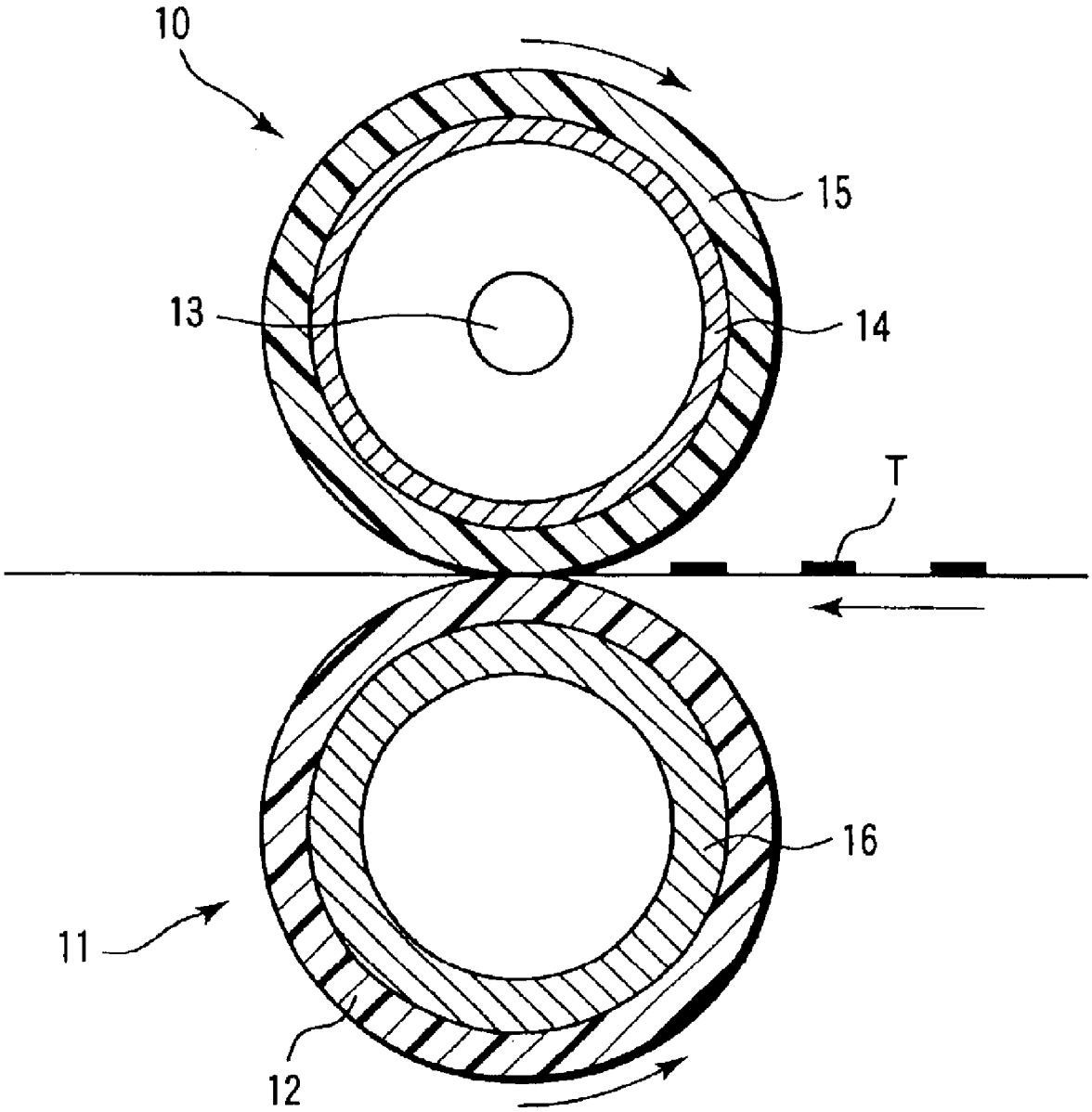
FIGURE

DEVELOPING AGENT

BACKGROUND OF THE INVENTION

1. Field of the Invention

The present invention relates to a developing agent to be employed for the development of an electrostatic latent image in electrophotography, etc. In particular, the present invention relates to a developing agent formed of a combination of full color toners comprising color toners such as a yellow toner, a magenta toner and a cyan toner, and a black toner.

2. Description of the Related Art

In recent years, as an image output apparatus based on electrophotography such as a copy machine, a printer, etc., there have been developed, in addition to a conventional monochromic image output device using only a black toner, a full color copy machine or full color printer which makes it possible to reproduce a wide range of colors through the employment of three primary colors such as yellow, magenta and cyan and further through a suitable superimposition of these color toners with a black toner, and these full color copy machines and printers are now available on the market.

In order to realize excellent color development and excellent reproduction of color image, the full color image to be obtained through such a full color apparatus should be such that the image portions thereof be formed from a color toner, in particular, through the superimposition of color toners of two or more kinds are required to be rendered in a state where the particles of the color toners are sufficiently fused and mixed in color, and furthermore, the image portions are required to have a suitable degree of glossiness so as to give a feeling of high-class and high quality to the full color image. In particular, if a full color image is to be formed on the surface of an OHT sheet, the image portions are required to be smooth and excellent in glossiness in order to realize excellent color development of projected image, thereby suppressing the scattering and irregular reflection of light that may be caused due to the irregularity of the surface of image portions, thus ensuring a sufficient degree of light transmittance at the image portions.

On the other hand, in view of the needs demanded by the users working in ordinary offices, in particular, it is increasingly needed to provide a full color copy machine and a full color printer which are capable, in addition to the situation where a full color image is to be produced, of creating a situation where only black toner is employed to produce a monochromatic image without undergoing the development of full color toners, to thereby make it possible to realize such a high speed image-producing capability as obtainable in the ordinary monochromatic copy machine or monochromatic printer. Further, with respect to the monochromatic image to be obtained, the qualities and features which greatly differ from those of a full color image are being pursued. Namely, since the monochromatic image is mainly intended to depict the image of a letter or character of a document, the glossiness of the image portions is required to be suppressed in order to minimize the reflection of light to be generated therefrom, thus alleviating the burden on one's eyes to thereby allow the letter and character to be easily identified.

As a matter of fact, however, the full color copy machine and the full color printer according to the prior art are incapable of meeting the aforementioned requirements when they are subjected to the monochromatic image-forming output. One of the reasons for this resides in the fact that the black toner to be employed in the conventional full color copy machine and full color printer is generally made so as to have almost the same degree of viscoelasticity as that of color toners, so that the image formed by the black toner is as high in glossiness as that formed by color toners, thus inevitably resulting in the formation or a monochromatic image, which is not suited for identification where the monochromatic image is a document or letter, etc.

There is another problem which will be attributed to the fact that, as the number of monochromatic images output is increased, the conventional full color machine is apparently disadvantageous in terms of durability in view of the construction of the fixing device mentioned above, i.e. the conventional full color machine is far inferior in durability to the ordinary monochromatic copy machine or monochromatic printer.

BRIEF SUMMARY OF THE INVENTION

According to the present invention, there is provided a developing agent comprising color toners and a black toner, the color toners including a yellow toner, a magenta toner and a cyan toner, wherein the black toner comprises a binder resin containing a crystalline polyester resin, and the yellow toner, the magenta toner and the cyan toner each comprise a binder resin containing no crystalline polyester resin.

According to a first aspect of the present invention, there is provided a developing agent comprising color toners and a black toner, the color toners including a yellow toner, a magenta toner and a cyan toner, wherein the yellow toner, the Magenta toner and the cyan toner each comprise, as a binder resin, a hybrid resin including a polycondensation resin moiety and an addition polymerization resin moiety which are chemically bonded to each other; and the black toner comprises, as a binder resin, a hybrid resin including a polycondensation resin moiety and an addition polymerization resin moiety which are chemically bonded to each other, and a crystalline polyester resin; the binder resin of the black toner having a haze value which is higher than the haze value of each of the binder resins of the yellow toner, the magenta toner and the cyan toner.

According to a second aspect of the present invention, there is provided a developing agent comprising color toners and a black toner, the color toners including a yellow toner, a magenta toner and a cyan toner, wherein the yellow toner, the magenta toner and the cyan toner each comprise, as a binder resin, a mixture of an H form of polyester mainly containing higher molecular components thereof, and an L form of polyester mainly containing lower molecular components thereof; and the black toner comprises, as a binder resin, mixture of an H form of polyester mainly containing higher molecular components thereof, and an L form of polyester mainly containing lower molecular components thereof, and a crystalline polyester resin; the binder resin of the black toner having a haze value which is higher than the haze value of each of the binder resins of the yellow toner, the magenta toner and the cyan toner.

According to a third aspect of the present invention, there is provided a developing agent comprising color toners and a black toner, the color toners including a yellow toner, a magenta toner and a cyan toner, wherein the yellow toner, the magenta toner and the cyan toner each comprises, as a binder resin, an amorphous polyester resin; and the black toner comprises, as a binder resin, an amorphous polyester resin and a crystalline polyester resin; the binder resin of the black toner having a haze value which is higher than the haze value of each of the binder resins of the yellow toner, the magenta toner and the cyan toner.

According to the present invention, there is also provided a method of forming an image, which comprises: successively developing an electrostatic latent image formed on a surface of an image carrier by making use of a developing agent comprising color toners and a black toner, the color toners including a yellow toner, a magenta toner and a cyan toner, and transferring the developed image onto a transfer material; wherein the black toner comprises a binder resin containing a crystalline polyester resin, and the color toners including a yellow toner, a magenta toner and a cyan toner each comprise a binder resin containing no crystalline polyester resin.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

The single FIGURE is a cross-sectional view schematically illustrating one embodiment of the heating roller constituting a fixing apparatus according to the present invention.

DETAILED DESCRIPTION OF THE INVENTION

Various embodiments according to the present invention will be further explained as follows.

A developing agent according to a first aspect of the present invention comprises color toners including a yellow toner, a magenta toner and a cyan toner, and a black toner; which is characterized in that the yellow toner, the magenta toner and the cyan toner each comprise, as a binder resin, a hybrid resin including a polycondensation resin moiety and an addition polymerization resin moiety which are chemically bonded to each other; and that the black toner comprises, as a binder resin, said hybrid resin and a crystalline polyester resin.

In the developing agent according to the first aspect of the present invention, the hybrid resin to be employed as a binder resin can be obtained, as described in JP Laid-open Patent Publication (Kokai) No.-8-171231 (1996), through a process wherein two kinds of raw monomer mixtures are mixed together and subjected to two kinds of polymerization reactions of two different polymerization systems each having an independent reaction route in the same reaction vessel to thereby obtain the hybrid resin.

These two kinds of polymerization reactions should preferably be proceeded according to an independent reaction route from each other to enable a polycondensation resin and an addition polymerization resin to be produced concurrently. Typical examples of this polycondensation resin include polyester, polyester/polyamide, polyamide, etc. Typical examples of this addition polymerization resin include a vinyl polymerization resin which can be obtained through a radical polymerization reaction.

Among them, the examples of the polyester moiety include the compounds exemplified in JP Laid-open Patent Publication (Kokai) No. 7-175260 (1995) which can be manufactured by referring to the methods described in this Patent Publication.

As for the examples of the raw monomers for the polyester resin, they include not less than dihydric alcohol moieties and not less than di-valent carboxylic acid moieties such as not less than di-valent carboxylic acid, carboxylic anhydride and carboxylate.

More specifically, examples of dihydric alcohol moieties include alkylene oxide adducts of bisphenol A such as polyoxypropylene(2,2)-2,2-bis(4-hydroxyphenyl)propane, polyoxypropylene(3,3)-2,2-bis(4-hydroxyphenyl)propane, polyoxyethylene(2,0)-2,2-bis(4-hydroxyphenyl)propane, polyoxypropylene(2,0)-polyoxyethylene(2,0)-2,2-bis(4-hydroxyphenyl)propane, and polyoxypropylene(6)-2,2-bis(4-hydroxyphenyl)propane; and also include ethylene glycol, diethylene glycol, triethylene glycol, 1,2-propylene glycol, 1,3-propylene glycol, 1,4-butane diol, neopentyl glycol, 1,4-butene diol, 1,5-pentane diol, 1,6-hexane diol, 1,4-cyclohexane dimethanol, dipropylene glycol, polyethylene glycol, polypropylene glycol, polytetramethylene glycol, bisphenol A, hydrogenated bisphenol A, etc.

Preferable examples of the dihydric alcohol moieties are alkylene (having two or three carbon atoms) oxide adducts (1–10 in average number of moles) of bisphenol A, ethylene glycol, propylene glycol, 1,6-hexane diol, bisphenol A and hydrogenated bisphenol A.

Specific examples of not less than trihydric alcohol moieties include sorbitol, 1,2,3,6-hexane tetrol, 1,4-sorbitan, pentaerythritol, dipentaerythritol, tripentaerythritol, 1,2,4-butane triol, 1,2,5-pentane triol, glycerol, 2-methylpropane triol, 2-methyl-1,2,4-butane triol, trimethylol ethane, trimethylol propane, 1,3,5-trihydroxymethyl benzene, etc.

Preferable examples of not less than trihydric alcohol moieties are sorbitol, 1,4-sorbitan, pentaerythritol, glycerol and trimethylol propane.

In order to obtain the polyester resin moieties of the hybrid resin, these not less than dihydric alcohol and not less than trihydric alcohol may be employed singly or in combination of two or more kinds thereof.

Specific examples of not less than di-valent carboxylic acid moieties include maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, alkenyl succinic acid such as n-dodecenyl succinic acid, alkyl succinic acid such as n-dodecyl succinic acid, anhydrides of these acids, lower alkyl esters of these acids, etc.

Preferable examples of the not less than di-valent carboxylic acid are maleic acid, fumaric acid, terephthalic acid, and succinic acid having a substituted alkenyl group having 2–20 carbon atoms.

Specific examples of not less than di-valent carboxylic acid moieties include, for example, 1,2,4-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxypropane, 1,2,4-cyclohexane tricarboxylic acid, tetra(methylenecarboxyl)methane, 1,2,7,8-octane tetracarboxylic acid, pyromellitic acid, enpole trimer, anhydrides of these acids, lower alkyl (having 1–12 carbon atoms) esters of these acids, etc.

In order to obtain the polyester resin moieties of the hybrid resin, these not less than di-valent carboxylic acids and not less than tri-valent carboxylic acids may be employed singly or in combination of two or more kinds thereof.

On the occasion of the polymerization of raw monomer of polyester, it is possible, for the purpose of promoting the reaction, to optionally employ an esterification catalyst which is commonly employed for this purpose such as dibutyltin oxide, etc.

As for the raw monomers that can be employed for forming amide moiety in the polyester/polyamide or polyamide, it is possible to employ various kinds of polyamines, aminocarboxylic acids, amine alcohols, all of which are known in the art, specific examples thereof being, for example, polyamines such as ethylene diamine, pentamethylene diamine, hexamethylene diamine, diethylene triamine, iminobispropyl amine, phenylene diamine, xylylene diamine, triethylene tetramine, etc.; aminocarboxylic acids such as 6-aminocaproic acid, ε-caprolactam, etc.; and amino alcohols such as propanol amine, etc. Among them, preferable examples are hexamethylene diamine and ε-caprolactam.

As for the raw monomers that can be employed for forming a vinyl polymerization type resin which can be obtained through an addition polymerization reaction, it is possible to employ, for instance, styrene or styrene derivatives such as styrene, o-methyl styrene, m-methyl styrene, p-methyl styrene, α-methyl styrene, p-ethyl styrene, 2,4-dimethyl styrene, p-chlorostyrene, vinyl naphthalene, etc.; ethylenic unsaturated mono-olefins such as ethylene, propylene, butylene, isobutylene, etc.; vinyl esters such as vinyl chloride, vinyl bromide, vinyl fluoride, vinyl acetate, vinyl propionate, vinyl formate, vinyl caproate, etc.; ethylenic monocarboxylic acids and the esters thereof such as acrylic acid, methyl acrylate, ethyl acrylate, n-propyl acrylate, isopropyl acrylate, n-butyl acrylate, isobutyl acrylate, tert-butyl acrylate, amyl acrylate, cyclohexyl acrylate, n-octyl acrylate, iso-octyl acrylate, decyl acrylate, lauryl acrylate, 2-ethylhexyl acrylate, stearyl acrylate, methoxyethyl acrylate, glycidyl acrylate, 2-chloroethyl acrylate, phenyl acrylate, α-methyl chloroacrylate, methacrylic acid, methyl methacrylate, ethyl methacrylate, n-propyl methacrylate, isopropyl methacrylate, n-butyl methacrylate, isobutyl methacrylate, tert-butyl methacrylate, amyl methacrylate, cyclohexyl methacrylate, n-octyl methacrylate, iso-octyl methacrylate, decyl methacrylate, lauryl methacrylate, 2-ethylhexyl methacrylate, stearyl methacrylate, methoxyethyl methacrylate, 2-hydroxyethyl methacrylate, glycidyl methacrylate, phenyl methacrylate, dimethylaminoethyl methacrylate, diethylaminoethyl methacrylate, etc.; ethylenic substituted monocarboxylic acid such as acrylonitrile, acrylamide; ethylenic dicarboxylic acid and substitution products thereof such as dimethyl maleate; vinyl ketones such as vinylmethyl ketones; vinyl ethers such as vinylmethyl ether; vinylidene chloride such as vinylidene halide; and N-vinyl compounds such as N-vinyl pyrrol, N-vinyl pyrrolidone, etc.

Among these monomers, more preferable examples are styrene; ethylenic unsaturated mono-olefins such as ethylene, propylene, etc.; diolefins such as butadiene; ethylenic monocarboxylic acids such as (metha)acrylic acid; and esters of ethylenic monocarboxylic acids such as alkyl (having 1–18 carbon atoms) esters of (metha)acrylic acids. More specific examples of them include styrene, α-methyl styrene, propylene, methyl acrylate, 2-ethylhexyl acrylate, stearyl acrylate, methyl methacrylate, butyl methacrylate and 2-hydroxyethyl methacrylate.

The hybrid resin should preferably be selected from those which can be manufactured by a process wherein a raw monomer for a polycondensation resin, a raw monomer for an addition polymerization resin and a polymerization initiator are mixed together to obtain a mixture, which is then subjected to a polymerization reaction consisting mainly of a radical polymerization reaction at a temperature ranging from 50° C. to 180° C. to thereby obtain an addition polymerization resin moiety having a functional group capable of undergoing a polycondensation reaction, and this resin moiety is further heated up and subjected to a reaction mainly consisted of the polycondensation reaction at a reaction temperature ranging from 190° C. to 270° C. to thereby form a polycondensation resin moiety, thus obtaining the hybrid resin. By employing this method wherein a couple of independent reactions are permitted to proceed in a single reaction vessel as described above, it is possible to efficiently obtain a resin composition wherein two kinds of resins are permitted to coexist with improved compatibility.

The weight ratio of the polycondensation resin to the addition polymerization resin, namely, the weight ratio of the raw monomer for the polycondensation resin to the raw monomer for the addition polymerization resin should preferably be confined to 50/50 to 95/5 in general, more preferably to 60/40 to 95/5 in view of the dispersibility of the addition polymerization resin.

By the way, the method of manufacturing the hybrid resin is not necessarily confined to the aforementioned method, but may be any other ordinary methods which are well known in the art. Namely, a catalyst may be mixed into the aforementioned monomer, if required, in the polycondensation thereof utilizing an esterification reaction or transesterification reaction. For example, the hybrid resin can be manufactured by referring to the methods (Paragraph Number 0131-0140) set forth in JP Laid-open Patent Publication (Kokai) No. 2001-272820 (2001).

The hybrid resin to be manufactured as described above may be formed of, depending on the molecular weight thereof, an H form mainly consisted of higher molecular weight moiety, and an L form mainly consisted of lower molecular weight moiety. Herein, the H form means a moiety of the hybrid resin having a number average molecular weight ranging from 4,000 to 20,000, and a softening point ranging from 130° C. to 170° C., while the L form means another moiety of the hybrid resin having a number average molecular weight ranging from 10,000 to 5,000, and a softening point ranging from 80° C. to 120° C.

The H form and L form of the hybrid resin can be separately manufactured depending on the selection of the kind and quantity of raw monomers, of polymerization initiators and of catalysts, which are to be employed in the manufacture of the hybrid resin, and also on the selection of the reaction conditions. The H form and L form should preferably be mixed together prior to the employment thereof, and there is no particular restriction with regard to the manner of mixing these bodies, i.e. the mixing of them may take place prior to or concurrent with the mixing of each of H form and L form with other kinds of raw materials.

With respect to the mixing weight ratio of the H form and L form, as the ratio of the H form is increased, the shelf life, environmental stability and electrification degree of the hybrid resin can be proportionally improved. On the other hand, as the ratio of the L form is increased, the low temperature fixability and hot offset resistance of the hybrid resin can be proportionally improved. In view of the balance between these features, the mixing ratio between the H form and the L form should preferably be confined within the range of 2–4:5–6 (H form:L form=2–4:5–8). However, if the feature of low temperature fixability is considered important, the mixing ratio of the L form should preferably be increased, but if the feature of shelf life is considered important, the mixing ratio of the H form should preferably be increased.

The hybrid resin to be manufactured as explained above can be employed as a binder for each of the color toners including a yellow toner, a magenta toner and a cyan toner.

The crystalline polyester resin to be employed as part of the binder resin for the black toner of developing agent according to the first aspect of the present invention can be obtained through a polycondensation between a monomer containing carboxylic acid moiety formed of not less than di-valent or polyvalent carboxylic acid and an alcoholic moiety formed of not less than dihydric alcohol or polyhydric alcohol.

As for examples of the carboxylic acid moiety, they include fumaric acid, maleic acid, citraconic acid, itaconic acid, glutaconic acid, phthalic acid, isophthalic acid, terephthalic acid, cyclohexane dicarboxylic acid, succinic acid, adipic acid, sebacic acid, azelaic acid, malonic acid, alkyl succinic acid substituted by alkyl group having 1 to 20 carbon atoms such as octyl succinic acid, alkenyl succinic acid substituted by alkenyl group having 2 to 20 carbon atoms such as n-dodecenyl succinic acid, anhydrides of these acids, and derivatives of these acids such as alkyl esters of these acids, etc.

As for examples of the alcoholic moiety, they include aliphatic polyols such as ethylene glycol, propylene glycol, 1,4-butane diol, 1,3-butane diol, 1,5-pentane diol, 1,6-hexane diol, neopentyl glycol, glycerin, trimethylol ethane, trimethylol propane, pentaerythritol, etc.; alicyclic polyols such as 1,4-cyclohexane diol, 1,4-cyclohexane dimethanol, etc.; and ethylene oxide or propylene oxide adduct of bisphenol A, etc.

In particular, it is desirable to employ crystalline polyester resins which can be obtained through a polycondensation between an alcoholic moiety having an alkyl or alkenyl group having not less than 16 carbon atoms and comprising not less than 80 mol % of diol having 2 to 6 carbon atoms and a carboxylic acid moiety containing not less than 80 mol % of fumaric acid, the resultant crystalline polyester resins being a wax-like crystalline compound in general and having a softening point ranging from 110° C. to 150° C. and a glass transition temperature ranging from 100° C. to 140° C., the difference between the melting point and the glass transition point thereof falling within the range of 0.1–10° C. These crystalline polyester resins may be employed individually or in combination of two or more kinds.

These crystalline polyester resins are subsequently mixed with the hybrid resin so as to be employed as a binder resin for the black toner. In this case, the content of the crystalline polyester resins should preferably be confined within the range of 1 to 30 parts by weight based on 100 parts by weight of the hybrid resin.

In this case, the acid value of the hybrid resin should preferably be smaller than the acid value of a mixture consisting of the hybrid resin and the crystalline polyester resins.

The developing agent according to the second aspect of the present invention is featured in that each of the yellow toner, the magenta toner and the cyan toner comprises, as a binder resin, a mixture of an H form of polyester mainly consisted of higher molecular components thereof, and an L form of polyester mainly consisted of lower molecular components thereof; and that the black toner comprises, as a binder resin, not only a mixture of the H form of polyester and the L form of polyester, but also a crystalline polyester resin.

Herein, the H form generally means a moiety of the polyester resin having a number average molecular weight ranging from 4,000 to 20,000, and a softening point ranging from 130° C. to 170° C., while the L form means another moiety of the polyester resin having a number average molecular weight ranging front 10,000 to 5,000, and a softening point ranging from 80° C. to 120° C.

The polyester resin can be synthesized by making use of an optional combination of the monomer components of carboxylic acid and alcohol which are set forth in the explanation of the first aspect of the present invention and by means of conventionally known methods. For example, a transesterification method and a direct polycondensation method may be employed individually or in combination of them in the synthesis of the polyester resin.

The H form and L form of the polyester resin can be separately manufactured depending on the selection of the kind and quantity of raw monomers, of polymerization initiators and of catalysts, which are to be employed in the manufacture of the polyester resin, and also on the selection of the reaction conditions. These H form and L form should preferably be mixed together prior to the employment thereof, and there is not any particular restriction with regard to the manner of mixing these bodies, i.e. the mixing of them may take place prior to or concurrent with the mixing of each of H form and L form with other kinds of raw materials.

With respect to the mixing weight ratio of these H form and L form, as the ratio of the H form is increased, the shelf life, environmental stability and electrification degree of the resin can be proportionally improved. On the other hand, as the ratio of the L form is increased, the low temperature fixability and hot offset resistance of the resin can be proportionally improved. In view of the balance between these features, the mixing ratio between the H form and the L form should preferably be confined within the range of 2–5:5–8 (H form:L form=2–5:5–8). However, if the feature of low temperature fixability is considered important, the mixing ratio of the L form should preferably be increased, but if the feature of shelf life is considered important, the mixing ratio of the H form should preferably be increased.

The crystalline polyester resins to be employed in the second aspect of the present invention may be the same as those employed in the first aspect of the present invention. These crystalline polyester resins are subsequently mixed with a mixture of the H form and L form of polyester resin so as to be employed as a binder resin for the black toner. In this case, the content of the crystalline polyester resins should preferably be confined within the range of 1 to 30 parts by weight based on 100 parts by weight of the mixture of the H form and L form of polyester resin.

In this case, the acid value of the mixture of the H form and L form should preferably be smaller than the acid value of a mixture consisting of the mixture of the H form and L form, and the crystalline polyester resins.

The developing agent according to the third aspect of the present invention is featured in that each of the yellow toner, the magenta toner and the cyan toner each comprise, as a binder resin, an amorphous polyester resin, and the black toner comprises, as a binder resin, not only an amorphous polyester resin, but also a crystalline polyester resin.

The amorphous polyester resin to be employed in the third aspect of the present invention can be separated into an H form, an M form and an L form according to the softening point thereof, wherein the H form generally means a moiety of the amorphous polyester resin having a softening point ranging from 130° C. to 170° C., the M form means a moiety of the amorphous polyester resin having a softening point ranging from 90° C. to 165° C., and the L form means a moiety of the amorphous polyester resin having a softening point ranging from 80° C. to 120° C.

The H form, M form and L form of the amorphous polyester resin can be separately manufactured depending on the selection of the kind and quantity of raw monomers, of polymerization initiators and of catalysts, which are to be employed in the manufacture of the amorphous polyester resin, and also on the selection of the reaction conditions. These H form, M form and L form should preferably be mixed together prior to the employment thereof, and there is no particular restriction with regard to the manner of mixing these bodies, i.e. the mixing of them may take place prior to or concurrent with the mixing of each of H form, M form and L form with other kinds of raw materials.

With respect to the mixing weight ratio of these H form, M form and L form, as the ratio of the H form is increased, the shelf life and hot offset resistance property of the resin can be proportionally improved. On the other hand, as the ratio of the L form is increased, the low temperature fixability and OHP permeability of the resin can be proportionally improved. In the cases of the yellow, magenta and cyan toners, the employment the M form in addition to the H form and L form is preferable. Because, it is possible, through the employment of the M form, to prevent the deterioration of the dispersion of pigment and wax in the step of kneading ingredients that may be caused due to a difference in viscosity between the H form and the L form. Of course, there is no particular restriction in the employment of the M form for black toner.

In view of above, the mixing ratio among the H form, the M form and the L form should preferably be confined within the range of 2–5:0.1–3:3–8 (H form:M form:L form= 2–5:0.1–3:3–8).

The crystalline polyester resins to be employed in the third aspect of the present invention may be the same as those employed in the first aspect of the present invention. These crystalline polyester resins are subsequently mixed with the amorphous polyester resin so as to be employed as a binder resin for the black toner. In this case, the content of the crystalline polyester resins should preferably be confined within the range of 1 to 30 parts by weight based on 100 parts by weight of the amorphous polyester resin.

Further, wax may be added to each of the toners of the developing agents according to the aforementioned first, second and third aspects of the present invention. The wax to be employed in this case should preferably be composed of at least two kinds of wax including a first wax having a melting point which is higher than that of the crystalline polyester resin by 10° C. or more, and a second wax having a melting point which is lower than that of the crystalline polyester resin by 10° C. or more. In this case, the quantity of wax to be added to the black toner should preferably be larger than the quantity of wax to be added to the color toners.

There is no particular limitation with regard to the kind of wax to be employed in this case. For example, it is possible to employ aliphatic hydrocarbon-based wax such as low molecular weight polyethylene, low molecular weight polypropylene, polyolefin copolymer, polyolefin wax, microcrystalline wax, paraffin wax and Fischer-Tropsch wax; oxides of aliphatic hydrocarbon-based wax such as polyethylene oxide wax; a block copolymer of these organic compounds mentioned above; vegetable wax such as candelilla wax, carnauba wax, Japan wax, jojoba wax and rice wax; animal wax such as bees wax, lanolin and spermaceti; mineral wax such as ozokerite, ceresin wax and petrolatum; wax mainly consisted of fatty ester such as montanate wax and castor wax; and wax comprising fatty ester which is partially or entirely deoxidized such as deoxidized carnauba wax.

It is also possible to employ other kinds of wax such as saturated linear fatty acid such as palmitic acid, stearic acid, montanic acid and long chain alkyl carboxylic acid having a long chain alkyl group; unsaturated fatty acid such as brassidic acid, eleostearic acid and parinaric acid; saturated alcohols such as stearyl alcohol, eicocyl alcohol, behenyl alcohol, carnaubyl alcohol, ceryl alcohol, melissyl alcohol and long chain alkyl alcohol having a long chain alkyl group; polyhydric alcohols such as sorbitol; fatty amide such as linolic amide, oleic amide and lauric amide; saturated fatty bisamide such as methylene bisstearic amide, ethylene biscapric amide, ethylene bislauric amide and hexamethylene bisstearic amide; unsaturated fatty amide such as ethylene bisoleic amide, hexamethylene bisoleic amide, N,N'-dioleyl adipic amide and N,N'-dioleyl sebacic amide; aromatic bisamide such as m-xylene bisstearic amide and N,N'-distearyl isophthalic amide; metal salts of fatty acid (generally called metal soap) such as calcium stearate, calcium laurate, zinc stearate and magnesium stearate; wax comprising aliphatic hydrocarbon wax which is grafted using vinyl monomer such as styrene or acrylic acid; partially esterified product of fatty acid and polyhydric alcohol such as behenic acid monoglyceride; and methyl esterified compounds having hydroxyl group which can be obtained by hydrogenating vegetable fats and oils.

When the melting point of the crystalline polyester which can be incorporated into the binder of black toner is within the range of 100 to 140° C., the wax to be employed as the aforementioned first wax having a melting point higher than 100° C. by 10° C., i.e. having a melting point of 110° C. or more can be selected from high-density low molecular weight polyethylene (124 to 133° C.) and low molecular weight polypropylene (145 to 164° C.). On the other hand, the wax to be employed as the aforementioned second wax having a melting point lower than 140° C. by 10° C., i.e. having a melting point of 130° C. or less can be selected from vegetable wax and animal wax such as candelilla wax (71° C.), carnauba wax (83° C.), rice wax (79° C.), jojoba wax (95° C.), white wax (53° C.) and bees wax (64° C.); aliphatic hydrocarbon wax such as paraffin wax (80 to 107° C.); long chain ester wax (90 to 95° C.); fatty ester (60 to 82° C.); wax having an acidic group (73° C.); metal salts of fatty acid such as zinc stearate (123° C.); montan wax (79 to 89° C.); montanate wax (56 to 92° C.); and low density low molecular weight polyethylene (103 to 124° C.).

In order to further improve the dispersibility of wax, the first wax should preferably be desolvated in the employment thereof by adding it to the solution on the occasion of the polymerization of the binder resin at a ratio of 0.1 to 8 parts by weight per 100 parts by weight of the solid matters in the solution.

Likewise, in order to further improve the dispersibility of wax, the second wax should preferably be desolvated in the employment thereof by adding it to the solution on the occasion of the polymerization of the binder resin at a ratio of 0.1 to 8 parts by weight per 100 parts by weight of the solid matters in the solution.

Among these two kinds of waxes, the wax which is lower in melting point is capable of exhibiting plasticizing effects, while the wax which is higher in melting point is capable of exhibiting mold-releasing effects. Namely, the wax which is lower in melting point contributes to the improvement of low temperature fixing property of toner to thereby further enhance the effects of the crystalline polyester resin, while the wax which is higher in melting point contributes to the high-temperature off-set resistance of toner.

As for the colorants to be employed in the developing agents according to the aforementioned first, second and third aspects of the present invention, it is possible to employ carbon black, organic or inorganic pigments and dyes. There is not any particular limitation with respect to the kinds of these colorants. For example, the carbon black can be selected from acetylene black, furnace black, thermal black, channel black, Ketchen black, etc. The pigments and dyes can be selected from Fast Yellow G, Benzidine Yellow, Indofast Orange, Irgazine Red, Carmine FB, Permanent Bordeaux FR, Pigment Orange, Lithol Red 2G, Lake Red C, Rhodamine FB, Rhodamine B Lake, Phthalocyanin Blue, Pigment Blue, Brilliant Green B, Phthalocyanin Green, quinacridone, etc. These pigments and dyes can be employed individually or in combination of two or more kinds.

An electrification-controlling agent may be incorporated into the developing agents according to the aforementioned first, second and third aspects of the present invention so as to control the magnitude of frictional electrification. As this electrification-controlling agent, metal-containing azo compounds can be employed, preferable examples of which being a complex, a complex salt or a mixture thereof wherein the metallic moiety is constituted by iron, cobalt or chromium. It is also possible to employ a metal-containing salicylic acid derivative, preferable examples of which being a complex, a complex salt or a mixture thereof wherein the metallic moiety is constituted by zirconium, zinc, chromium or boron.

In order to control the fluidity and electrification of the toner particles which can be obtained through the aforementioned process, a fine inorganic particle may be incorporated into the developing agents according to the aforementioned first, second and third aspects of the present invention at a ratio of 0.2 to 3% by weight based on the weight of the toner particles. As for specific examples of this fine inorganic particle, it is possible to employ silica, titania, alumina, strontium titanate, tin oxide, etc., which can be employed individually or in combination of two or more kinds. In this case, it is preferable, in view of improving the environmental stability thereof, to surface-treat this fine inorganic particle by making use of a hydrophobicity-providing agent prior to the employment thereof. Further, other than the aforementioned inorganic oxides, it is possible to incorporate a fine resin particle having a particle diameter of 1 $\mu$m or less to thereby improve the cleaning property of the toners.

As mixing and dispersing means to be employed in the manufacture of the toners, various kinds of mixer and kneader can be employed.

As for the mixer, it is possible to employ, for example, Henschel mixer (Mitsui Kozan Co., Ltd.); Super mixer (Kawata Co., Ltd.); Ribokon (Ohkawara Seisakusho Co., Ltd.); Nauter mixer, Turbulerizer, Cyclomix (Hosokawa Micron Co., Ltd.); Spiral Pin mixer (Taiheiyou Kiko Co., Ltd.); Readyge mixer (Matsuboh Co., Ltd.), etc. As for the kneader, it is possible to employ, for example, KRC kneader (Kurimoto Tekkosho Co., Ltd.); Buss•Co•kneader (Buss Co., Ltd.); TEM type extruder (Toshiba Kikai Co., Ltd.); TEX biaxial kneader (Nippon Seikosho Co., Ltd.); PCM kneader (Ikegai Tekkosho Co., Ltd.); a triple roll mill, a mixing roll mill, a kneader (Inoue Seisakusho Co., Ltd.); Kneadex (Mitsui Mining Co., Ltd.); MS type pressure kneader, Kneader-ruder (Moriyama Seisakusho Co., Ltd.); Banbury mixter (Kohbe Seikohsho Co., Ltd.), etc.

As for the means to coarsely crush the mixture, it is possible to employ a hammer mill, a cutter mill, a jet mill, a roller mill, a ball mill, etc. As for the grinding machine to be employed as means for finely pulverizing the coarsely crushed material, it is possible to employ a Counter Jet mill, Micron jet, Inomizer (Hosokawa Micron Co., Ltd.); IDS type mill, PJM Jet crusher (Nippon Nuematic Kogyo Co., Ltd.); Cross-jet mill (Kurimoto Tekkosho Co., Ltd.); Ulmax (Nisso Engineering Co., Ltd.); SK Jet•O•mill (Seishin Kigyo Co., Ltd.); Kryptolon (Kawasaki Heavy Industries Co., Ltd.); Turbomill (Turbo Kogyo Co., Ltd.), etc. furthermore, as for the classifier for classifying the finely pulverized material, it is possible to employ Classier, Micron classifier, Spedic classifier (Seishin Kigyo Co., Ltd.); Turbo classifier (Nissin Engineering Co., Ltd.); Micron separator, Turboplex (ATP), TSP separator (Hosokawa Micron Co., Ltd.); Elbow Jet (Nittetsu Kogyo Co., Ltd.); Dispersion separator (Nippon Nuematic Kogyo Co., Ltd.); and YM Microcut (Yasukawa Shoji Co., Ltd.).

As for the means for incorporating external additives, it is possible to employ the aforementioned mixers.

As for the screening device to be employed for classifying coarse particles, it is possible to employ Ultrasonic (Kouei Sangyo Co., Ltd.); Resonasieve, Gyroshifter (Tokuju Kousakusho Co., Ltd.); Vibrasonic system (Dulton Co., Ltd.); Zonicreen (Shinto Kogyo Co., Ltd.); Turboscreener (Turbo Kogyo Co., Ltd.); Microshifter (Makino Sangyo Co., Ltd.); and a circular vibrating screen, etc.

As for a carrier which can be employed together with the toners, it is possible to preferably employ ferrite particles each having a particle diameter ranging from about 80 $\mu$m to 40 $\mu$m and comprising a core particle made of a material represented by $(MO)_x(Fe_2O_3)_y$ (wherein M is one or not less than two kinds of metals selected from the group consisting of Li, Mg, Mn, Fe(II), Co, Ni, Cu, Zn, Cd, Sr and Ba; and X/Y<1.0) and covered with silicone resin, the ferrite particles exhibiting $1\times10^{+10}$ to $3\times10^{+11}$ in resistance of 250V/6.5 mm gap.

The developing agent according to various aspects of the present invention explained above can be suitably employed in the method of forming an image, where a fixing step by means of predetermined fixing devices is involved. FIGURE shows one example of the fixing device which can be employed in the present invention. Referring to FIGURE, the fixing device is constituted by a contact roller 10, a pressure roller 11 and a heating source 13. The contact roller 10 and the pressure roller 11 are disposed so as to be contacted with each other at a predetermined pressure while providing a nip of predetermined width therebetween.

The contact roller 10 comprises a core 14 having on its surface a covering layer 15 composed of a fluorinated resin, and the heating source 13 which is disposed inside the core 14.

The core 14 is made of a metal selected from the group consisting of aluminum, iron and copper, or made of an alloy containing at least one kind of these metals. This core 14 should preferably be configured such that the inner diameter is confined within the range of 10 to 50 mm and the radial thickness is confined within the range of 0.1 to 2 mm. The radial thickness of this core 14 can be determined in taking into consideration the balance between the demands of saving energy (reduction of thickness) and the mechanical strength (which depends on the material to constitute the core 14). For example, if it is desired to form the core by making use of aluminum while securing the same degree of mechanical strength as that of an iron core having a radial thickness of 0.57 mm for instance, the radial thickness of the aluminum core is required to be set to 0.8 mm.

As for the fluorinated resin for the covering layer 15, it is possible to employ PTFE (polytetrafluoroethylene) or PFA (tetrafluoroethylene-perfluoroalkylvinyl ether copolymer). The thickness of the covering layer 15 may preferably be in the range of about 50 to 1000 $\mu$m.

As for the heating source 13, it is possible to employ an electromagnetic induction coil or a halogen heater. The number of the heating source may not be confined to only one but may be divided into plural heating sources, thereby enabling the distributing region of heat to be optionally altered depending on the size (width) of the paper passing therethrough.

The pressure roller 10 is configured such that a covering layer 16 made of silicone rubber is placed on the surface of the core 12. The core 14 is made of a metal such as aluminum and iron, or an alloy containing any of these metals. The thickness of this covering layer 16 should preferably be confined within the range of 1 to 30 mm. The silicone rubber constituting the covering layer 16 should preferably be formed so as to have an Ascar C hardness ranging from 35 to 90. This silicone rubber may be formed of silicone sponge rubber.

The contact load (total load) between the contact roller 10 and the pressure roller 11 should preferably be confined within the range of 300 to 900 N (newton) in general. This contact load can be determined by taking the mechanical strength (the radial thickness of the core 14) of the contact roller 10 into consideration. For example, in the case of the contact roller where the core thereof is made of iron having a thickness of 0.3 mm, the contact load should preferably be confined to 500 N or less. In view of the off-set resistance and fixing properties, the width of the nip therebetween should preferably be confined within the range of 4 to 8 mm.

In the process of fixing, a toner image formed by making use of a developing agent satisfying the aforementioned desirable properties is subsequently fixed, through contact-heating, onto a transfer material. In this case, it is preferable that the black toner exhibits a lowest fixable temperature which is lower than that of the color toners.

On the occasion of performing the image-forming process using the aforementioned developing agents, the image to be formed is not confined to a color image where color toners and black toner are employed using a color image-forming apparatus. Namely, the formation of a monochromic image where only a black toner is employed can be performed by making use of the same color image-forming apparatus. In this case, by suitably combining the color toners and the black toner according to each of the aforementioned aspects of the present invention, either one of color image and monochromic image can be optionally formed while making it possible to provide an image of excellent quality which is demanded in the formation of a color image or a monochromic image.

The following are examples of the present invention, which however are not intended to limit the present invention. In these Examples, "part(s)" described therein is based on weight.

EXAMPLES

The fixing device shown in FIGURE was modified so as to meet the following conditions to thereby prepare a modified fixing device. Specifically, the fixing roller used in this modified fixing device was constructed to have a PFA tube layer on the surface thereof and a diameter of 40 mm. Likewise, a pressure roller used in this case was constructed to have a silicone rubber layer on the surface thereof and a diameter of 30 mm. Further, the magnitude of pressure was set to 700 N, and the temperature of the fixing roller was made adjustable by means of a thermistor disposed to contact with the fixing roller, thereby setting the temperature of the fixing roller to 160° C. In this case, the magnitude of pressure was finely adjusted so as to control the magnitude of nip to 6 mm. The fixing speed was set to 200 mm/sec.

Example 1

According to the ordinary method and in a nitrogen atmosphere, a mixture consisting of 400 parts of styrene, 130 parts of n-butyl acrylate and 20 parts of dicumyl peroxide was added dropwise over four hours to a mixture consisting of 35 parts of the OP adduct of bisphenol A, 600 parts of the EO adduct of bisphenol A, 250 parts of terephthalic acid, 40 parts of trimellitic anhydride, 35 parts of fumaric acid, and 3 parts of dibutyl tin oxide with stirring at a temperature of 135° C. while keeping a reduced pressure. The resultant mixture was then allowed to age for four hours at a temperature of 135° C. and thereafter heated up to 230° C. to allow the mixture to take place the reaction thereof, thereby obtaining an H form of hybrid resin having a softening temperature of 136° C. and a number average molecular weight of 15,000.

Then, according to the ordinary method and in a nitrogen atmosphere, a mixture consisting of 200 parts of styrene, 35 parts of 2-ethylhexyl acrylate and 20 parts of dicumyl peroxide was added dropwise over four hours to a mixture consisting of 700 parts of the OP adduct of bisphenol A, 320 parts of the EO adduct of bisphenol A, 55 parts of isododecenyl succinic anhydride, 330 parts of terephthalic acid, 50 parts of trimellitic anhydride, 60 parts of fumaric acid, and 3 parts of dibutyl tin oxide with stirring at a temperature of 135° C. while keeping a reduced pressure. The resultant mixture was then allowed to age for four hours at a temperature of 135° C. and thereafter heated up to 230° C. to allow the mixture to take place the reaction thereof, thereby obtaining an L form of hybrid resin having a softening temperature of 101° C. and a number average molecular weight of 4,000.

On the other hand, 95 parts of 1,4-butane diol, 5 parts of glycerin, 100 parts of fumaric acid and 5 parts of hydroquinone were mixed together, and was allowed to react for five hours at a temperature ranging from 150° C. to 170° C. in a nitrogen atmosphere. Thereafter, this reaction mixture was heated up to 200° C. and allowed to proceed the reaction thereof for one hour while gradually reducing the pressure of the nitrogen atmosphere. As the pressure of the nitrogen atmosphere was reduced down to 8 kPa, the reaction mixture was further allowed to proceed the reaction thereof for one hour to thereby obtain crystalline polyester resin having a melting point of 119° C.

By making use of these H form and L form of hybrid resin, and the crystalline polyester resin, six kinds of toners (Examples 1-1 to 1-3, and Comparative Examples 1-1 to 1-3) having the following compositions were manufactured.

Binder resin: The composition thereof is shown in the following Table 1

| | |
|---|---|
| Colorant: | 6 parts |
| Electrification-controlling agent: | 1 part |
| First wax: | 2–4 parts (a value which can be obtained by subtracting the quantity of the second wax from the quantity described in the following Table 1) |
| Second wax: | 2 parts |

These materials were mixed together by means of a Henschel mixer, and then fused and kneaded by means of a double-screw extruder. The resultant kneaded melt was allowed to cool, and then coarsely crushed by means of a hammer mill. Thereafter, this crushed material was finely pulverized by means of a jet pulverizer to obtain pulverized particles, which were then subjected to classification to obtain powder having a volume average diameter of 9 μm. Then, 0.5 part of hydrophobic silica and 0.5 part of hydrophobic titanium oxide were added to 100 parts of this powder and mixed together by means of a Henschel mixer to thereby manufacture a toner.

Then, the lowest fixable temperature of the toner thus manufactured was determined as follows.

Namely, since this lowest fixable temperature is a temperature enabling 75% or more of the residual fixing ratio, the residual fixing ratio has been determined as follows. Namely, the preset temperature of the heat roller of the fixing device was successively raised, under which conditions a transfer paper having a toner image transferred thereto was subjected to the fixing treatment thereof by means of the fixing device. Then, the image thus fixed was measured with respect to the concentration of the image of the image portion. Thereafter, this image portion was subjected to a rubbing treatment using a 100% cotton pat and then measured again with respect to the concentration of the image, thereby calculating and determining the residual fixing ratio according to the following formula.

Residual fixing ratio=(Concentration of image after rubbing/Concentration of image before rubbing)×100%.

The results are shown in the following Table 1.

Crystalline polyester resin: Crystallinity was 5 to 50, and melting point was in the range of 50° C. to 140° C.;

Haze value of binder resin: After being placed on a slide glass and thermally fused at a temperature of 160° C. by means of a hot plate, the binder resin was allowed to spread over the surface of slide glass to form a layer thereof having a thickness of 100 μm and the haze value of the binder resin was measured by means of a direct-reading type haze degree computer.

Haze value of toner: After adjusting the quantity of toner to be fixed to 1.0 mg/cm$^2$, the toner was allowed to fix on the surface of OHP sheet at a temperature of 160° C. and the haze value of the toner was measured by means of a direct-reading type haze degree computer.

Color difference: A distance between the coordinates of the original and the coordinates of the copy image was determined by making use of CIE L*a*b* color space.

As apparent from this Table 1, the lowest fixable temperature of each of the toners according to Examples 1-1 to 1-3 of the present invention was 150° C. or less in the case of the color toners, i.e. yellow toner, magenta toner and cyan toner; and as low as not more than 140° C. in the case of the black toner, thus indicating a relatively wide range of the fixing temperature.

Whereas, in the case of the toners according to Comparative Example 1-1 where the cyan toner also contained crystalline polyester resin, and the haze value of the binder resin indicated no difference between the cyan toner and the black toner, the lowest fixable temperature of the black toner was higher than that of the cyan toner. Further, in the case of the toners according to Comparative Example 1-2 where the cyan toner indicated a higher haze value of the binder resin as compared with the black toner as well as according

TABLE 1

| | | Binder resin | | | | | Toner | | | |
|---|---|---|---|---|---|---|---|---|---|---|
| | | Mixing ratio | | | | | | | | |
| | | Hybrid resin | | | | | | | | |
| | Toner colors | H form | L form | Crystalline resin | Haze value | Acid value | Quantity of wax | Haze value | Minimum fixable temperature | Color difference in color toner |
| Example 1-1 | Yellow | 4 | 6 | — | 5 | 3 | 4 | 15 | 150 | 0.36 |
| | Magenta | 4 | 6 | — | 5 | 3 | 4 | 18 | 150 | 1.6 |
| | Cyan | 4 | 6 | — | 5 | 3 | 4 | 19 | 150 | 6.58 |
| | Black | 4 | 4 | 2 | 30 | 25 | 6 | 45 | 135 | — |
| Example 1-2 | Cyan | 0 | 8 | — | 3 | 5 | 4 | 18 | 145 | 7.01 |
| | Black | 4 | 5.9 | 0.1 | 20 | 28 | 6 | 35 | 140 | — |
| Example 1-3 | Cyan | 5 | 5 | — | 7 | 4 | 4 | 22 | 155 | 6.95 |
| | Black | 5 | 2 | 3 | 40 | 20 | 6 | 50 | 130 | — |
| Comparative | Cyan | 4 | 4 | 2 | 30 | 25 | 4 | 46 | 130 | 15.5 |
| Example 1-1 | Black | 4 | 4 | 2 | 30 | 25 | 6 | 45 | 135 | — |
| Comparative | Cyan | 6 | 4 | — | 8 | 30 | 4 | 20 | 170 | 6.88 |
| Example 1-2 | Black | 6 | 4 | — | 5 | 3 | 6 | 18 | 160 | — |
| Comparative | Cyan | 5 | 5 | — | 7 | 4 | 6 | 25 | 160 | 7.49 |
| Example 1-3 | Black | 4 | 4 | 2 | 25 | 25 | 2 | 40 | 150 | — |

H form: Number average molecular weight = 4,000 to 20,000; Softening point = 130° C. to 170° C.;
L form: Number average molecular weight = 1,000 to 5,000; Softening point = 80° C. to 120° C.;
Crystalline polyester resin: Crystallinity was 5 to 50, and melting point was in the range of 50° C. to 140° C.;
Haze value of binder resin: After being placed on a slide glass and thermally fused at a temperature of 160° C. by means of a hot plate, the binder resin was allowed to spread over the surface of slide glass to form a layer thereof having a thickness of 100 μm and the haze value of the binder resin was measured by means of a direct-reading type haze degree computer.
Haze value of toner: After adjusting the quantity of toner to be fixed to 1.0 mg/cm$^2$, the toner was allowed to fix on the surface of OHP sheet at a temperature of 160° C. and the haze value of the toner was measured by means of a direct-reading type haze degree computer.
Color difference: A distance between the coordinates of the original and the coordinates of the copy image was determined by making use of CIE L*a*b* color space.

H-form: Number average molecular weight=4,000 to 20,000; Softening point=130° C. to 170° C.;

L form: Number average molecular weight=1,000 to 5,000; Softening point=80° C. to 120° C.;

to Comparative Example 1-3 where the cyan toner contained a larger quantity of wax as compared with the black toner, the lowest fixable temperature was not higher than 170° C. in the cyan toner, and not higher than 160° C. in the black toner, thus indicating relatively high values of the lowest fixable temperature and relatively narrow ranges of the lowest fixable temperature, and hence indicating poor fixing properties of the toners of these Comparative Examples.

Example 2

According to the ordinary method and in a nitrogen atmosphere, a mixture consisting of 70 parts of the OP adduct of bisphenol A, 30 parts of the EO adduct of bisphenol A, 20 parts of trimellitic anhydride, 35 parts of succinic acid, and 3 parts of dibutyl tin oxide was stirred at a temperature of 200° C. while keeping a reduced pressure, thereby obtaining an H form of polyester resin having a softening temperature of 147° C. and a number average molecular weight of 12,000.

Then, according to the ordinary method and in a nitrogen atmosphere, a mixture consisting of 95 parts of the OP adduct of bisphenol A, 5 parts of the EO adduct of bisphenol A, 5 parts of isododecenyl succinic anhydride, 80 parts of isophthalic acid, 10 parts of trimellitic anhydride, 5 parts of fumaric acid, and 3 parts of dibutyl tin oxide was stirred at a temperature of 135° C. while keeping a reduced pressure, thereby obtaining an L form of polyester resin having a softening temperature of 101° C. and a number average molecular weight of 4,000.

On the other hand, 95 parts of 1,4-butane diol, 5 parts of glycerin, 100 parts of fumaric acid and 5 parts of hydroquinone were mixed together, and was allowed to react for five hours at a temperature ranging from 150° C. to 170° C. in a nitrogen atmosphere. Thereafter, this reaction mixture was heated up to 200° C. and allowed to proceed the reaction thereof for one hour while gradually reducing the pressure of the nitrogen atmosphere. As the pressure of the nitrogen atmosphere was reduced down to 8 kPa, the reaction mixture was further allowed to proceed the reaction thereof for one hour to thereby obtain crystalline polyester resin having a melting point of 119° C.

By making use of these H form and L form of polyester resin, and the crystalline polyester resin, eight kinds of toners (Examples 2-1 to 2-3, and Comparative Examples 2-1 to 2-5) having the following compositions were manufactured.

Binder resin: The composition thereof is shown in the following Table 2

| | |
|---|---|
| Colorant: | 6 parts |
| Electrification-controlling agent: | 1 part |
| First wax: | 2–4 parts (a value which can be obtained by subtracting the quantity of the second wax from the quantity described in the following Table 2) |
| Second wax: | 2 parts |

These materials were mixed together by means of a Henschel mixer, and then fused and kneaded by means of a double-screw extruder. The resultant kneaded melt was allowed to cool, and then coarsely crushed by means of a hammer mill. Thereafter, this crushed material was finely pulverized by means of a jet pulverizer to obtain pulverized particles, which were then subjected to classification to obtain powder having a volume average diameter of 9 $\mu$m. Then, 0.5 part of hydrophobic silica and 0.5 part of hydrophobic titanium oxide were added to 100 parts of this powder and mixed together by means of a Henschel mixer to thereby manufacture a toner.

Then, the characteristics of each of the toners thus manufactured were determined in the same manner as described in Example 1. The results thus obtained are shown in the following Table 2.

TABLE 2

| | | Binder resin | | | | | Toner | | |
|---|---|---|---|---|---|---|---|---|---|
| | | Mixing ratio | | | | | Quantity | | Minimum |
| | Toner colors | H form | L form | Crystalline form | Haze value | Acid value | of wax (%) | Haze value | fixable temperature |
| Example 2-1 | Yellow | 4 | 6 | — | 7 | 4 | 4 | 17 | 150 |
| | Magenta | 4 | 6 | — | 7 | 4 | 4 | 19 | 150 |
| | Cyan | 4 | 6 | — | 7 | 4 | 4 | 15 | 150 |
| | Black | 4 | 4 | 2 | 30 | 30 | 6 | 40 | 135 |
| Example 2-2 | Cyan | 2 | 8 | — | 5 | 5 | 4 | 18 | 150 |
| | Black | 4 | 5 | 1 | 25 | 25 | 6 | 40 | 140 |
| Example 2-3 | Cyan | 5 | 5 | — | 5 | 7 | 4 | 22 | 155 |
| | Black | 5 | 2 | 3 | 35 | 25 | 6 | 50 | 130 |
| Comparative | Cyan | 4 | 4 | 2 | 30 | 25 | 4 | 46 | 130 |
| Example 2-1 | Black | 4 | 4 | 2 | 30 | 25 | 6 | 45 | 135 |
| Comparative | Cyan | 6 | 4 | — | 8 | 4 | 4 | 20 | 170 |
| Example 2-2 | Black | 4 | 4 | 2 | 30 | 25 | 6 | 45 | 135 |
| Comparative | Cyan | 5 | 5 | — | 7 | 4 | 4 | 45 | 160 |
| Example 2-3 | Black | 6 | 3 | 1 | 25 | 25 | 6 | 42 | 160 |
| Comparative | Cyan | 5 | 5 | — | 7 | 30 | 4 | 47 | 160 |
| Example 2-4 | Black | 4 | 4 | 2 | 25 | 25 | 6 | 45 | 150 |

TABLE 2-continued

| | | Binder resin | | | | | Toner | | |
|---|---|---|---|---|---|---|---|---|---|
| | | Mixing ratio | | | | | Quantity | | Minimum |
| | Toner colors | H form | L form | Crystalline form | Haze value | Acid value | of wax (%) | Haze value | fixable temperature |
| Comparative | Cyan | 6 | 4 | — | 10 | 4 | 6 | 45 | 160 |
| Example 2-5 | Black | 6 | 3 | 1 | 25 | 25 | 2 | 40 | 150 |

H form: Number average molecular weight = 4,000 to 20,000; Softening point = 130° C. to 170° C.;
L form: Number average molecular weight = 1,000 to 5,000; Softening point = 80° C. to 120° C.;
Crystalline polyester resin: Crystallinity was 5 to 50, and melting point was in the range of 50° C. to 140° C.;
Haze value of binder resin: After being placed on a slide glass and thermally fused at a temperature of 160° C. by means of a hot plate, the binder resin was allowed to spread over the surface of slide glass to form a layer thereof having a thickness of 100 μm and the haze value of the binder resin was measured by means of a direct-reading type haze degree computer.
Haze value of toner: After adjusting the quantity of toner to be fixed to 1.0 mg/cm$^2$, the toner was allowed to fix on the surface of OHP sheet at a temperature of 160° C. and the haze value of the toner was measured by means of a direct-reading type haze degree computer.

As apparent from this Table 2, the lowest fixable temperature of each of the toners according to Examples 2-1 to 2-3 of the present invention was 155° C. or less in the case of the color toners, i.e. yellow toner, magenta toner and cyan toner; and as low as not more than 140° C. in the case of the black toner, thus indicating a relatively wide range of the fixing temperature.

Whereas, in the case of the toners according to Comparative Example 2-1 where the haze value of the binder resin indicated no difference between the cyan toner and the black toner, the lowest fixable temperature of the black toner was higher than that of the cyan toner. Further, in the toners according to Comparative Example 2-2 where the cyan toner contained a higher ratio of H form than the L form, in the toners according to Comparative Example 2-3 where the black toner contained a higher ratio of H form than the L form, in the toners according to Comparative Example 2-4 where the acid value of the cyan toner was higher than the acid value of the black toner, and in the toners according to Comparative Example 2-5 where the cyan toner indicated a higher haze value of binder resin as compared with that of the black toner, the lowest fixable temperature was found as high as 160° C. to 170° C.°, thus making the lowest fixable temperature relatively narrow in range, indicating poor fixing properties of the toners of these Comparative Examples.

Example 3

According to the ordinary method and in a nitrogen atmosphere, a mixture consisting of 85 parts of the OP adduct of bisphenol A, 15 parts of the EO adduct of bisphenol A, 10 parts of terephthalic acid, 18 parts of trimellitic anhydride, 65 parts of isophthalic acid, and 3 parts of dibutyl tin oxide was subjected to aging with stirring for four hours at a temperature of 135° C. while keeping a reduced pressure. Then, the resultant mixture was heated up to 230° C. to allow the mixture to take place the reaction thereof, thereby obtaining an H form of amorphous polyester resin having a softening temperature of 150.2° C.

Then, according to the ordinary method and in a nitrogen atmosphere, a mixture consisting of 70 parts of the OP adduct of bisphenol A, 30 parts of the EO adduct of bisphenol A, 45 parts of isophthalic acid, 35 parts of terephthalic acid, 10 parts of trimellitic anhydride, 10 parts of fumaric acid, and 3 parts of dibutyl tin oxide was subjected to aging with stirring for four hours at a temperature of 135° C. while keeping a reduced pressure. Then, the resultant mixture was heated up to 230° C. to allow the mixture to take place the reaction thereof, thereby obtaining an M form of amorphous polyester resin having a softening temperature of 125.1° C.

Then, according to the ordinary method and in a nitrogen atmosphere, a mixture consisting of 80 parts of the OP adduct of bisphenol A, 20 parts of the EO adduct of bisphenol A, 70 parts of isophthalic acid, 20 parts of terephthalic acid, and 3 parts of dibutyl tin oxide was subjected to aging with stirring for four hours at a temperature of 135° C. while keeping a reduced pressure. Then, the resultant mixture was heated up to 230° C. to allow the mixture to take place the reaction thereof, thereby obtaining an L form of amorphous polyester resin having a softening temperature of 106.4° C.

On the other hand, 95 parts of 1,4-butane diol, 5 parts of glycerin, 100 parts of fumaric acid and 5 parts of hydroquinone were mixed together, and was allowed to react for five hours at a temperature ranging from 150° C. to 170° C. in a nitrogen atmosphere. Thereafter, this reaction mixture was heated up to 200° C. and allowed to proceed the reaction thereof for one hour while gradually reducing the pressure of the nitrogen atmosphere. As the pressure of the nitrogen atmosphere was reduced down to 8 kPa, the reaction mixture was further allowed to proceed the reaction thereof for one hour to thereby obtain crystalline polyester resin having a melting point of 119° C.

By making use of these H form, M form and L form of amorphous polyester resin, and the crystalline polyester resin, seven kinds of toners (Examples 3-1 to 3-3, and Comparative Examples 3-1 to 3-4) having the following compositions were manufactured.

Binder resin: The composition thereof is shown in the following Table 3

| | |
|---|---|
| Colorant: | 6 parts |
| Electrification-controlling agent: | 1 part |
| First wax: | 2–4 parts (a value which can be obtained by subtracting the quantity of the second wax from the quantity described in the following Table 2) |
| Second wax: | 2 parts |

These materials were mixed together by means of a Henschel mixer, and then fused and kneaded by means of a double-screw extruder. The resultant kneaded melt was allowed to cool, and then coarsely crushed by means of a hammer mill. Thereafter, this crushed material was finely pulverized by means of a jet pulverizer to obtain pulverized particles, which were then subjected to classification to obtain powder having a volume average diameter of 9 μm. Then, 0.5 part of hydrophobic silica and 0.5 part of hydrophobic titanium oxide were added to 100 parts of this powder and mixed together by means of a Henschel mixer to thereby manufacture a toner.

Then, the characteristics of each of the toners thus manufactured were determined in the same manner as described in Example 1. The results thus obtained are shown in the following Table 3.

TABLE 3

| | | Binder resin | | | | | | Toner | | |
|---|---|---|---|---|---|---|---|---|---|---|
| | | Mixing ratio | | | | | | | | |
| | Toner Colors | H form | M form | L form | crystalline form | Haze value | Acid value | Quantity of wax (%) | Haze value | Minimum fixable temperature (° C.) |
| Example 3-1 | Yellow | 3 | 2 | 5 | 0 | 7 | 4 | 4 | 17 | 155 |
| | Magenta | 3 | 2 | 5 | 0 | 7 | 4 | 4 | 19 | 155 |
| | Cyan | 3 | 2 | 5 | 0 | 7 | 4 | 4 | 15 | 155 |
| | Black | 3 | 0 | 5 | 2 | 30 | 30 | 6 | 40 | 140 |
| Example 3-2 | Cyan | 1 | 1 | 8 | 0 | 6 | 3 | 4 | 12 | 150 |
| | Black | 1 | 1 | 6 | 2 | 28 | 26 | 6 | 35 | 135 |
| Example 3-3 | Cyan | 5 | 2 | 3 | 0 | 10 | 7 | 4 | 22 | 160 |
| | Black | 5 | 0 | 3 | 2 | 32 | 32 | 6 | 45 | 150 |
| Comparative | Cyan | 1 | 1 | 8 | 0 | 6 | 3 | 4 | 12 | 150 |
| Example 3-1 | Black | 1 | 1 | 8 | 0 | 6 | 3 | 6 | 11 | 150 |
| Comparative | Cyan | 2 | 0 | 8 | 0 | 6 | 4 | 4 | 34 | 160 |
| Example 3-2 | Black | 2 | 0 | 7.5 | 0.5 | 11 | 16 | 6 | 23 | 150 |
| Comparative | Cyan | 3 | 2 | 5 | 0 | 7 | 28 | 4 | 19 | 145 |
| Example 3-3 | Black | 3 | 0 | 5 | 2 | 30 | 5 | 6 | 42 | 165 |
| Comparative | Cyan | 3 | 2 | 5 | 0 | 7 | 4 | 6 | 18 | 145 |
| Example 3-4 | Black | 3 | 0 | 5 | 2 | 30 | 30 | 4 | 39 | 145 |

H form: Softening point = 130° C. to 170° C.;
M form: Softening point = 90° C. to 165° C.;
L form: Softening point = 80° C. to 120° C.;
Crystalline polyester resin: Crystallinity was 5 to 50, and melting point was in the range of 50° C. to 140° C.;
Haze value of binder resin: After being placed on a slide glass and thermally fused at a temperature of 160° C. by means of a hot plate, the binder resin was allowed to spread over the surface of slide glass to form a layer thereof having a thickness of 100 μm and the haze value of the binder resin was measured by means of a direct-reading type haze degree computer.
Haze value of toner: After adjusting the quantity of toner to be fixed to 1.0 mg/cm$^2$, the toner was allowed to fix on the surface of OHP sheet at a temperature of 160° C. and the haze value of the toner was measured by means of a direct-reading type haze degree computer.

As apparent from this Table 3, the lowest fixable temperature of each of the toners according to Examples 3-1 to 3-3 of the present invention was all low, indicating a relatively wide range of the fixing temperature.

Whereas, in the case of the toners according to Comparative Example 3-1 where the acid value of the binder resin indicated no difference between the cyan toner and the black toner, in the case of the toners according to Comparative Example 3-3 where the binder resin of the black toner contained no M form of the amorphous polyester, and in the case of the toners according to Comparative Example 3-4 where the quantity of wax in the cyan toner was larger than that of the black toner, the lowest fixable temperature of the black toner was almost the same with or higher than that of the cyan toner. Further, in the case of the toners according to Comparative Example 3-2 where the binder resin of the cyan toner and of the black toner contained no M form of the amorphous polyester, the haze value of the cyan toner was found higher than that of the black toner.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A developing agent comprising color toners and a black toner, said color toners including a yellow toner, a magenta toner and a cyan toner, wherein the black toner comprises a binder resin containing a crystalline polyester resin, and the yellow toner, the magenta toner and the cyan toner each comprise a binder resin containing no crystalline polyester resin.

2. A method of forming an image, which comprises:

successively developing an electrostatic latent image formed on a surface of an image carrier by making use of a developing agent comprising color toners and a black toner, said color toners including a yellow toner, a magenta toner and a cyan toner, and transferring the developed image onto a transfer material;

wherein the black toner comprises a binder resin containing a crystalline polyester resin, and the yellow toner, the magenta toner and the cyan toner each comprise a binder resin containing no crystalline polyester resin.

* * * * *